US009255479B2

(12) United States Patent
Pauli et al.

(10) Patent No.: US 9,255,479 B2
(45) Date of Patent: Feb. 9, 2016

(54) HIGH PRESSURE COMPRESSOR

(71) Applicant: ALSTOM Technology Ltd., Baden (CH)

(72) Inventors: Ernst Pauli, Zuerich (CH); Sergey Shchukin, Mellingen (CH); Daniel Seng, Wettingen (CH)

(73) Assignee: ALSTOM TECHNOLOGY LTD, Baden (CH)

( * ) Notice: Subject to any disclaimer, the term of this patent is extended or adjusted under 35 U.S.C. 154(b) by 432 days.

(21) Appl. No.: 13/705,573

(22) Filed: Dec. 5, 2012

(65) Prior Publication Data

US 2013/0170954 A1 Jul. 4, 2013

(30) Foreign Application Priority Data

Dec. 6, 2011 (CH) ..... 1928/11

(51) Int. Cl.
*F04D 29/58* (2006.01)
*F01D 5/08* (2006.01)
(Continued)

(52) U.S. Cl.
CPC *F01D 5/08* (2013.01); *F01D 5/082* (2013.01); *F04D 29/053* (2013.01); *F04D 29/321* (2013.01); *F04D 29/584* (2013.01); *F05B 2260/201* (2013.01); *F05B 2260/2241* (2013.01); *F05D 2260/201* (2013.01); *F05D 2260/22141* (2013.01)

(58) Field of Classification Search
CPC ..... F01D 5/082; F01D 5/08; F01D 5/081; F01D 9/065; F01D 25/12; F05D 2260/201; F05D 2260/22141; F04D 29/584; F04D 29/5846; F04D 29/321; F05B 2260/201; F05B 2260/2241
USPC ..... 415/115–116, 175–177, 180; 416/95, 416/96 R, 97 R
See application file for complete search history.

(56) References Cited

U.S. PATENT DOCUMENTS

| | | | | |
|---|---|---|---|---|
| 2,648,519 A | | 4/1948 | Campini | |
| 3,768,921 A | * | 10/1973 | Brown et al. | 415/116 |
| 3,883,263 A | * | 5/1975 | Mai | 415/116 |

(Continued)

FOREIGN PATENT DOCUMENTS

| | | |
|---|---|---|
| DE | 2633222 | 1/1978 |
| DE | 3116923 | 4/1982 |

(Continued)

OTHER PUBLICATIONS

Search Report for Swiss Patent App. No. 01928/11 (Mar. 28, 2012).

(Continued)

*Primary Examiner* — Christopher Verdier
(74) *Attorney, Agent, or Firm* — Buchanan Ingersoll & Rooney PC

(57) ABSTRACT

A high-pressure compressor (12), in particular in a gas turbine (10), has a compressor rotor (17) which is surrounded by a stator (18, 19) thereby forming a main flow channel (25) and which is delimited at the compressor outlet by an end face (30) substantially extending in the radial direction, along which end face cooling air (21) is conveyed in the radial direction for the purpose of cooling. A prolonged service life is achieved in that the end face (30) is provided with a first system (23, 24) for improving the heat transfer between the cooling air (21) and the end face (30).

11 Claims, 3 Drawing Sheets

(51) Int. Cl.
*F04D 29/053* (2006.01)
*F04D 29/32* (2006.01)

(56) References Cited

U.S. PATENT DOCUMENTS 4,793,772 A * 12/1988 Zaehring et al. ..... 416/95
4,808,073 A 2/1989 Zaehring et al.
4,919,590 A * 4/1990 Stratford et al. ..... 415/116
5,232,339 A 8/1993 Plemmons et al.
5,297,386 A 3/1994 Kervistin
5,685,158 A 11/1997 Lenahan et al.
2003/0133788 A1* 7/2003 Avignon et al. ..... 415/115
2009/0010751 A1* 1/2009 McCaffrey et al. ..... 415/116
2013/0028750 A1* 1/2013 Dombek et al. ..... 416/90 R

FOREIGN PATENT DOCUMENTS

DE 3736836 5/1989
WO WO2009/071910 6/2009

OTHER PUBLICATIONS

Search Report for German Patent App. No. 10 2012 023 626.3 (Jul. 12, 2013).

* cited by examiner

HIGH PRESSURE COMPRESSOR

This application claims priority under 35 U.S.C. §119 to Swiss application no. 01928/11, filed 6 Dec. 2011, the entirety of which is incorporated by reference herein.

BACKGROUND

1. Field of Endeavor

The present invention relates to the field of gas turbine technology, and more particularly to a high-pressure compressor.

2. Brief Description of the Related Art

A greatly simplified diagram for a gas turbine is illustrated in FIG. 1: The gas turbine 10 of FIG. 1 includes a compressor 12 which sucks in and compresses ambient air 11, a combustion chamber 13 in which fuel 14 is combusted by using the compressed air and hot gas is generated, and a turbine 15 in which the hot gas is work-expanded and is then discharged as exhaust gas 16.

Modern high-pressure compressors (HPC) are exposed to comparatively high temperatures at their sections on the outlet side. These high temperatures very often cause problems with regard to the integrity of the rotor and to corresponding limitations of the service life. Thus, the occurrence of high metal temperatures at the rotor of a high-pressure compressor is a critical factor which influences the service life of the gas turbine rotor and which is included in the overall maintenance costs of the machine.

The rotor geometry typically used for high-pressure compressors shall have on the outlet side a smooth surface of the rotor disk, along which surface air is blown radially in the one or the other direction. In the case that the air is used for cooling the rotor disk, this results in the disadvantage that the cooling effect is not sufficient and the air exits the hollow space on the outlet side without the cooling capacity of the air being fully exhausted.

SUMMARY

One of numerous aspects of the invention includes an improved high-pressure compressor of the aforementioned kind, such that the compressor is cooled in the region of the outlet side with a significantly improved effectiveness.

Another aspect includes a high-pressure compressor which has a compressor rotor which is surrounded by a stator, thereby forming a main flow channel, and which is delimited at the compressor outlet by an end face substantially extending in the radial direction, along which end face cooling air is conveyed in the radial direction for the purpose of cooling. The end face is provided with first means for improving the heat transfer between the cooling air and the end face.

Another aspect includes that the means for improving the heat transfer between the cooling air and the end face comprises, on the end face, a plurality of radially oriented blades which are arranged distributed over the circumference and which form cooling channels between each other for conveying the cooling air.

In particular, the blades are molded onto the compressor rotor.

Another configuration includes that the blades are formed curved counter to the rotational direction of the compressor rotor.

Preferably, the curvature of the blades follows a parabola, a hyperbola, or a function in the form of a polynomial.

A further configuration includes that second means are provided which impose a tangential speed component in the rotational direction of the compressor rotor onto the cooling air impinging onto the end face.

In particular, the second means comprises a concentric turbulator nozzle arranged in the stator, through which nozzle the cooling air exits from an interior formed in the stator and flows toward the end face.

Here, the turbulator nozzle can be formed by a group of suitable blades.

However, the turbulator nozzle can also be formed by tangentially oriented boreholes.

Yet another configuration includes that a cooling cavity is formed between the end face and the stator and that the cooling cavity is separated from the main flow channel by a seal.

Another aspect includes a gas turbine having a high-pressure compressor as described herein.

BRIEF DESCRIPTION OF THE DRAWINGS

The invention is explained in more detail hereinafter by means of exemplary embodiments with reference to the drawing. In the figures.

DETAILED DESCRIPTION OF EXEMPLARY EMBODIMENTS

The modification in the configuration of the compressor rotor region on the outlet side described within the present context shall serve for lowering the temperature in the solid portion of the rotor or the rotor disk and for reducing temperature gradients occurring at the outlet side during transition states.

For this purpose, on the one hand, the surface of the rotor disk (end face) is designed for an improved heat transfer so as to increase the heat flow from the air to the disk. On the other hand, the cooling air at the stator is fed through swirl generators so as to be able, due to the relative movement, to reduce the temperature of the cooling air. In this manner, a very effective cooling of the outlet side of the compressor rotor is achieved.

Figure 1:
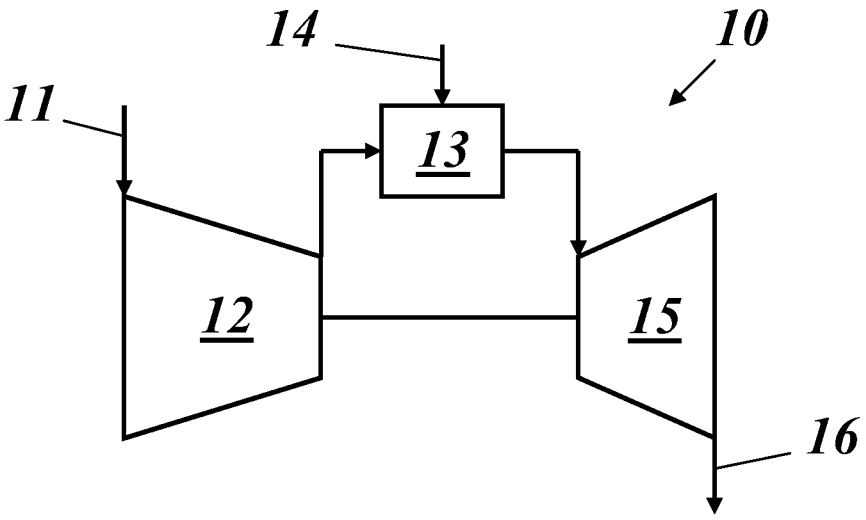
FIG. 1 shows a greatly simplified diagram for a gas turbine.
Figure 2:
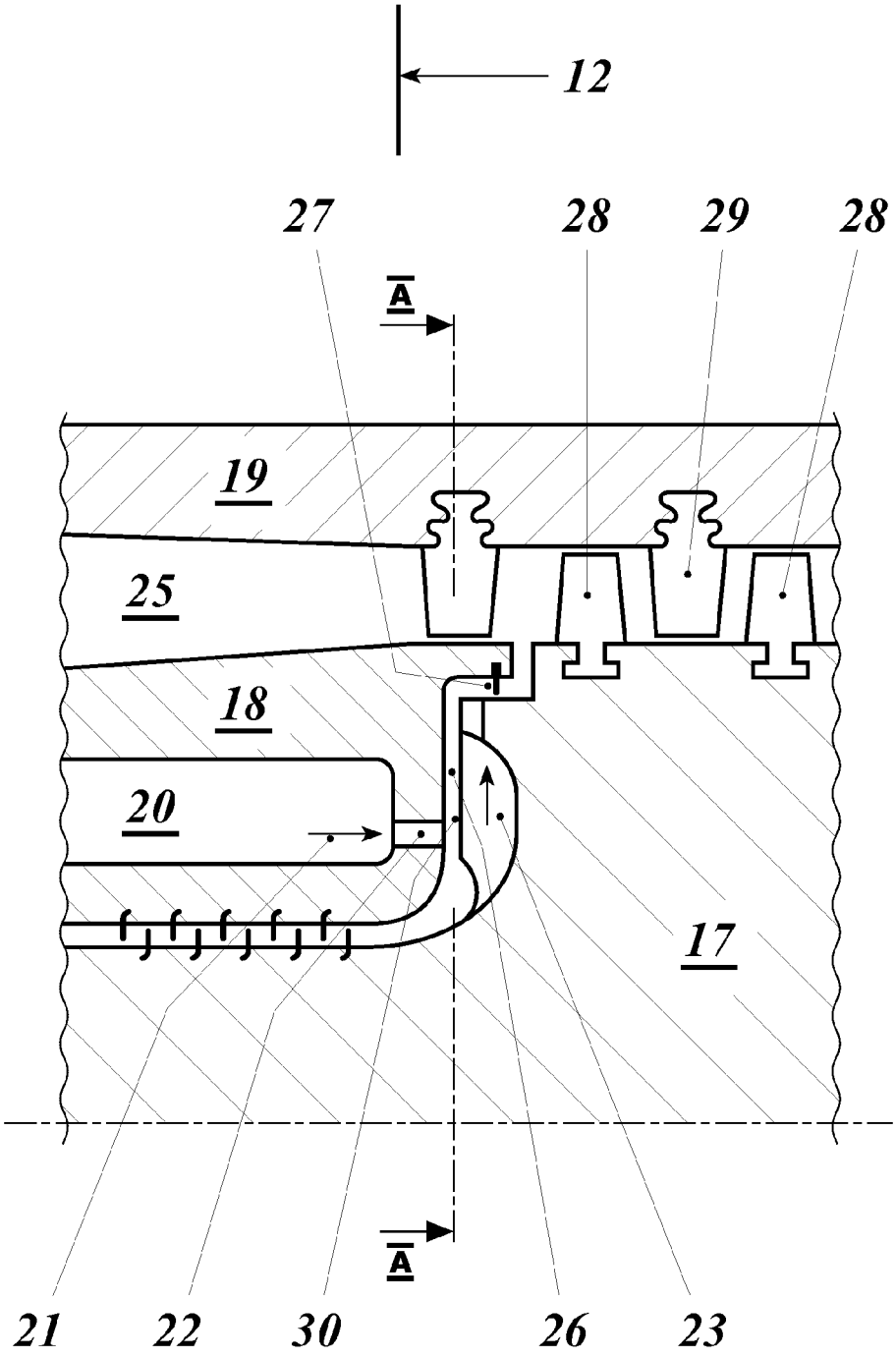
FIG. 2 shows a longitudinal section of a gas turbine section which represents the region of the outlet side of the high-pressure compressor.

According to FIG. 2, the gas turbine includes, in the region of the compressor outlet, a rotor 17 that is surrounded by an inner stator part 18 and an outer stator part 19 between which a main flow channel 25 is formed. The compressor 12 has a blading that includes rotor blades 28 arranged on the rotor 17 and guide blades 29 arranged on the outer stator part 19.

Figure 3:
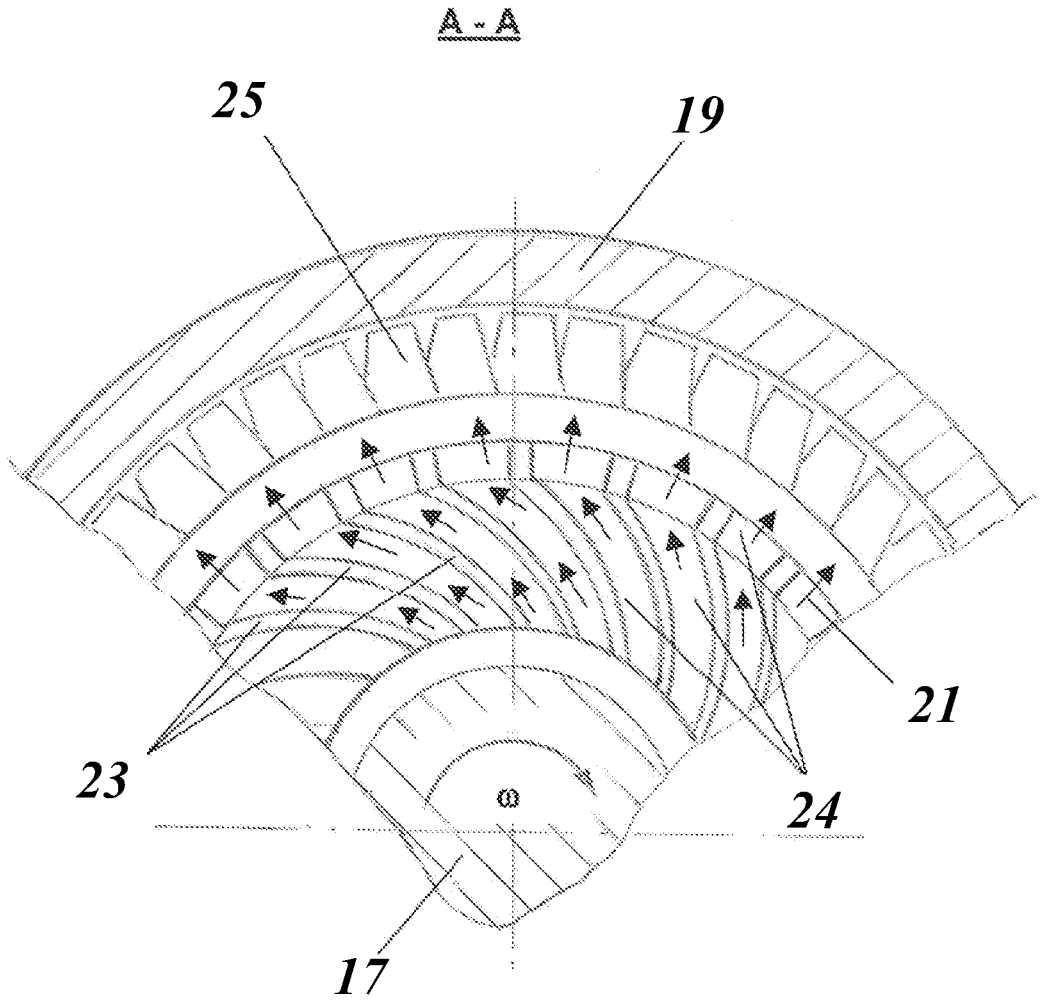
FIG. 3 shows the section in the plane A-A in FIG. 2.

Cooling air 21 is fed from an interior 20 in the inner stator part 18 through a turbulator nozzle 22 to the rotor's 17 outlet side that is delimited by the end face 30 extending in the radial direction. The turbulator nozzle 22 can be formed of a group of suitable blades or tangentially oriented boreholes. The nozzle generates cooling air with a tangential speed in the direction of the rotational speed ($\omega$ in FIG. 3). This enables lowering the relative temperature of the cooling air that impinges on the back side of the compressor rotor 17 onto the end face 30, and minimizes the frictional heat and the loss of power.

On the outlet side or end face 30 of the compressor rotor 17 (or the last compressor disk), radially oriented blades 23 are formed and arranged uniformly distributed over the circumference. Between the blades 23, cooling channels 24 are created in which the inflowing cooling air 21 is radially conveyed from the inside to the outside and is finally discharged into the main flow channel 25.

The course of the blades 23 can follow a given function such as, e.g., a parabola or hyperbola, or another curve defined by a polynomial. However, in any case, the blades 23 are curved counter to the rotational direction (see FIG. 3) in order to minimize the loss of power associated with pumping air, and to minimize the heating of the air due to friction in the channels 24.

In the individual case, the cooling cavity 26 formed between the inner stator part 18 and the rotor 17 in the region of the blades 23 can also be separated from the main flow channel 25 by a seal 27, as shown in FIG. 2.

REFERENCE LIST

10 Gas turbine
11 Air inlet
12 Compressor
13 Combustion chamber
14 Fuel
15 Turbine
16 Exhaust gas
17 Rotor
18 Inner stator part
19 Outer stator part
20 Interior
21 Cooling air
22 Turbulator nozzle
23 Blade
24 Cooling channel
25 Main flow channel
26 Cooling cavity
27 Seal
28 Rotor blade
29 Guide blade
30 End face
ω Rotational speed While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

We claim:

1. A high-pressure compressor comprising:

a compressor rotor including a plurality of rotor disks being successively arranged in an axial direction, and a compressor stator surrounding the rotor thereby forming a main flow channel therebetween, the compressor stator including an outer stator part and an inner stator part;

a compressor outlet; and a rotor end face on the last of said plurality of rotor disks at the compressor outlet extending in a radial direction, along which end face cooling air can be conveyed in the radial direction for cooling;

wherein the end face is surrounded by the inner stator part and faces in an axially downstream direction and includes first means for improving the heat transfer between the cooling air and the end face.

2. The high-pressure compressor according to claim 1, wherein the means for improving the heat transfer between the cooling air and the end face comprises, on the end face, a plurality of radially oriented blades which are circumferentially distributed and form cooling channels between each other for conveying the cooling air.

3. The high-pressure compressor according to claim 2, wherein the plurality of blades are molded onto the compressor rotor.

4. The high-pressure compressor according to claim 2, wherein each of the plurality of blades is formed curved counter to a rotational direction (ω) of the compressor rotor.

5. The high-pressure compressor according to claim 4, wherein a curvature of each of the plurality of blades follows a parabola, a hyperbola, or a polynomial function.

6. The high-pressure compressor according to claim 1, comprising:

second means for imposing a tangential speed component in the rotational direction (ω) of the compressor rotor onto the cooling air impinging onto said end face.

7. The high-pressure compressor according to claim 6, wherein:

the stator comprises an interior; and the second means comprises a concentric turbulator nozzle which is arranged in the stator and through which cooling air exits from said stator interior and flows toward the end face.

8. The high-pressure compressor according to claim 7, wherein the turbulator nozzle comprises a group of blades.

9. The high-pressure compressor according to claim 7, wherein the turbulator nozzle comprises tangentially oriented boreholes.

10. The high-pressure compressor according to claim 1, further comprising:

a cooling cavity formed between the end face and the stator; and a seal separating the cooling cavity from the main flow channel.

11. A gas turbine comprising a high-pressure compressor according to claim 1.

* * * * *